US005407410A

United States Patent [19]

Heck

[11] Patent Number: 5,407,410

[45] Date of Patent: Apr. 18, 1995

[54] HAND-HELD AID FOR HUMAN LOCOMOTION

[76] Inventor: Steven H. Heck, 305 E. Melrose Ave., Baltimore, Md. 21212

[21] Appl. No.: 78,456

[22] Filed: Jun. 16, 1993

[51] Int. Cl.[6] ..... A63B 26/00

[52] U.S. Cl. ..... 482/74; 482/47; 482/49

[58] Field of Search ..... 482/49, 47, 44, 74, 482/148

[56] References Cited

U.S. PATENT DOCUMENTS

| | | | |
|---|---|---|---|
| D. 226,736 | 4/1973 | Benis | 482/47 X |
| 1,962,971 | 6/1934 | Schipper . | |
| 2,461,695 | 2/1949 | McMahon | 482/47 X |
| 3,084,547 | 4/1963 | Nielsen | 482/49 X |
| 3,129,939 | 4/1964 | Stock . | |
| 3,557,776 | 1/1971 | Boots et al. . | |
| 3,606,316 | 9/1971 | Krewer | 482/47 |
| 4,218,057 | 8/1980 | Wilson . | |
| 4,240,624 | 12/1980 | Wilson . | |
| 4,278,248 | 7/1981 | Kifferstein . | |
| 4,351,526 | 9/1982 | Schwartz . | |
| 4,610,447 | 9/1986 | Byrd . | |
| 4,659,076 | 4/1987 | Valentine et al. . | |
| 4,929,211 | 5/1990 | Resnick et al. | 482/49 X |
| 4,984,784 | 1/1991 | Bailey | 482/49 X |
| 5,076,569 | 12/1991 | Gootter | 482/49 |
| 5,190,504 | 3/1993 | Scatterday | 482/49 |

FOREIGN PATENT DOCUMENTS

| | | |
|---|---|---|
| 937658 | 3/1948 | France . |
| 1112170 | 11/1955 | France . |

OTHER PUBLICATIONS

Cooper and Glassow, "Kinesiology", C. V. Mosby & Co., St. Louis (1976), pp. 37–44.

*Primary Examiner*—Richard J. Apley
*Assistant Examiner*—Donna L. Maraglio
*Attorney, Agent, or Firm*—Leonard Bloom

[57] ABSTRACT

A hand lever to be held in the hand of a person to aid in locomotion. A rigid, lightweight, non-compressible device which has a first segment with a leading edge. A rear segment has a convex edge and an intermediate segment is between the front and rear segments. The fingers of the person grip the leading edge of the front segment and press the convex edge of the rear segment of the device toward the heel of the person's hand. The top edge of the first segment is curved and is capped by the person's thumb. The hand lever, when held by the person, aligns, intensifies, and projects the hand, forearm and ultimately, the total body drive through space.

12 Claims, 3 Drawing Sheets

HAND-HELD AID FOR HUMAN LOCOMOTION

FIELD OF THE INVENTION

The present invention relates to a hand held aid for human locomotion and, more particularly, to a device held in the hand of a person which is rigid, non-compressible and lightweight.

BACKGROUND OF THE INVENTION

Persons exercising by running, jogging and walking frequently carry items in their hands. The item may be elongated as a stick or rod, a weighted device to provide additional stress on the body, a device to serve as a pacifier, or a device to increase balance. The applicant is aware of the following references directed to devices to attain at least one of these goals or towards devices used in other types of exercises:

| Patent No. | Patentee |
|---|---|
| 1,962,971 | Schipper |
| 3,129,939 | Stock |
| 3,557,776 | Boots |
| 4,218,057 | Wilson |
| 4,240,624 | Wilson |
| 4,278,248 | Kifferstein |
| 4,351,526 | Schwartz |
| 4,610,447 | Byrd |
| 4,659,076 | Valentine et al |
| French 937,658 | Faggi |
| French 1,112,170 | Benassy |

Some of these items are resilient and compressible in order to exercise the hand and forearm muscle. The Boots reference is a pacifier to relieve nervous energy by stroking the thumb in a groove formed in the device. The handbar of Valentine et al also has a thumb placement portion and provides visual and tactile stimulation to a runner. The devices of Wilson, Kifferstein and Schwartz are all weighted devices. The application of handweights is detrimental to integrated body movement. Since the specific purpose of said weights is the exercising of the hand, forearm, arm and shoulder muscle groups, the use of oxygen and energy in this manner reduces the force which could otherwise be utilized in propulsion. Furthermore, weights disrupt the fluidity of stroke by both arms and legs necessary in any aerobic activity requiring steady repetitive movement associated with efficient rhythm. The two French references are for devices contoured to fit the fingers.

While these references disclose devices which, to some extent, assist a person in improving their locomotion such as running, jogging or walking, the devices are either large, heavy or have other features which are not conducive nor designed to be an extended force of kinetic forearm power.

SUMMARY OF THE INVENTION

It is an object of the present invention to provide a lightweight, rigid, non-compressible device which is held in the hand and which aids in locomotion.

It is a further object of the present invention to provide an economical, easily manufactured device which when held in the hand, aligns, intensifies and projects the drive of the hand, forearm and total body through space.

In accordance with the teachings of the present invention, there is disclosed a hand lever to be held and completely enveloped in a hand of a person engaged in locomotion. The hand lever includes a rigid, non-compressible, lightweight, kidney-shaped device having a front segment. The front segment has a leading edge and a trailing edge with a top curved edge being formed therebetween. The leading edge of the first segment is gripped by the fingers of the person holding the device. The top curved portion is held by the thumb of the person holding the device. A rear segment has a convex edge and an intermediate segment is between the front segment and the rear segment. When the hand lever is gripped by the person, the rear segment is pressed into the hand toward the heel of the person's hand. In this manner the hand lever extends the force of the forearm drive of the person with the elbow of the person acting as a fulcrum point of an arm stroke and energy of the upper body is transmitted through the rear segment and the intermediate segment and up and out through the front segment. The person's thumb caps the front segment and acts to stabilize a hand stroke and to balance the person.

These and other objects of the present invention will become apparent from a reading of the following specification, taken in conjunction with the enclosed drawings.

DESCRIPTION OF THE PREFERRED EMBODIMENTS

Figure 1:
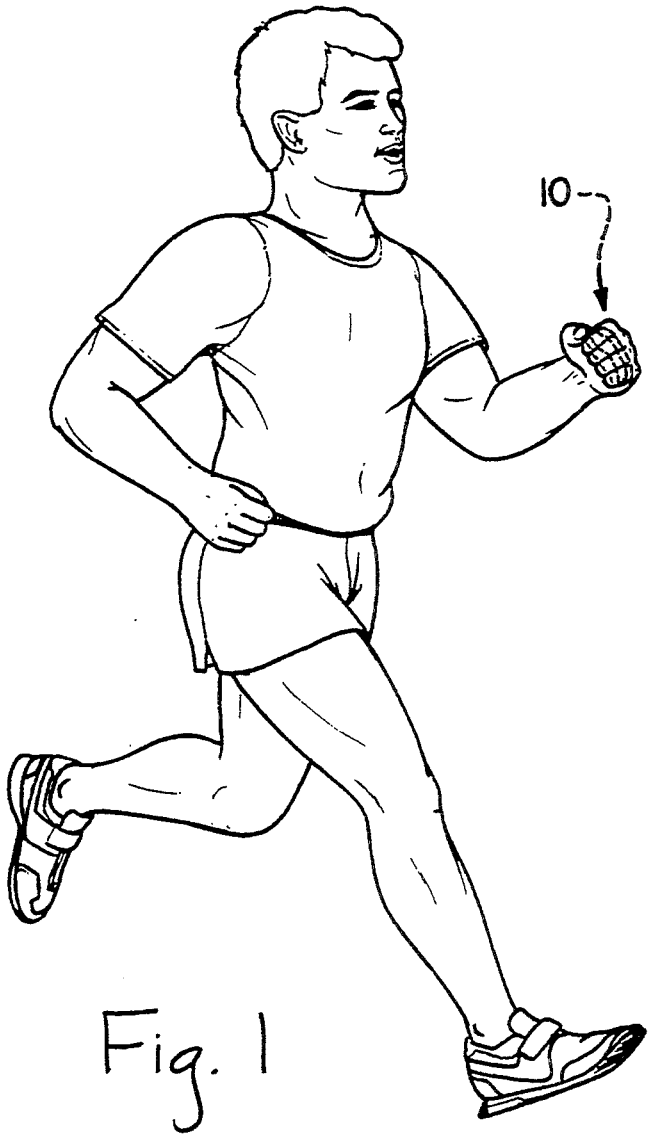
FIG. 1 is a perspective view of a person running and holding the hand lever in the person's hand showing the leading edge of the front segment formed as a convex edge.
Figure 2:
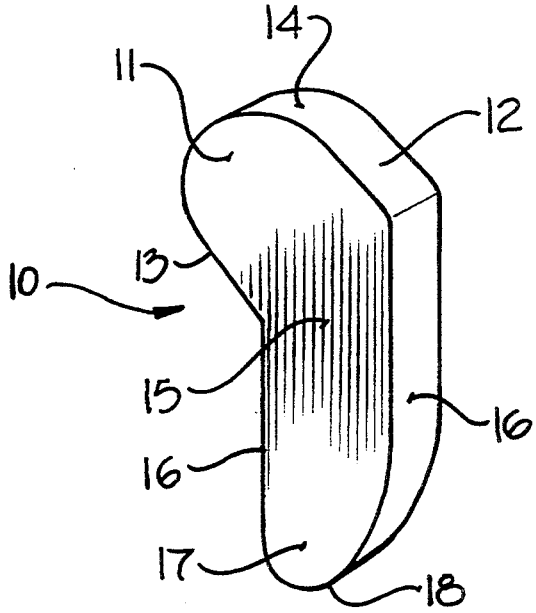
FIG. 2 is a perspective view of the device of the present invention.
Figure 4:
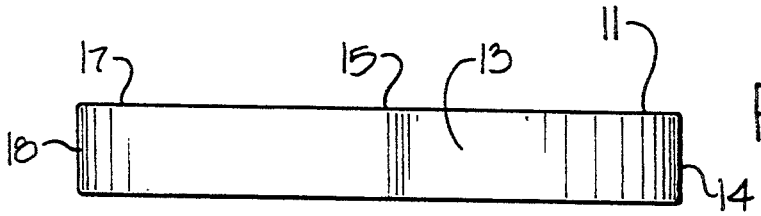
FIG. 4 is a top plan view of the device of the present invention.
Figure 3:
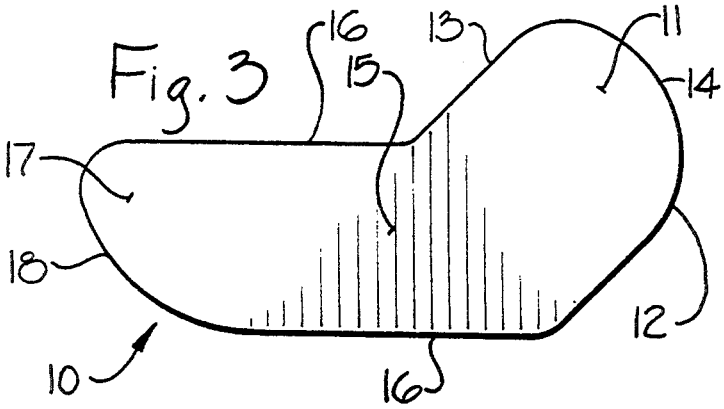
FIG. 3 is a side elevation view of the device of the present invention.
Figure 5:
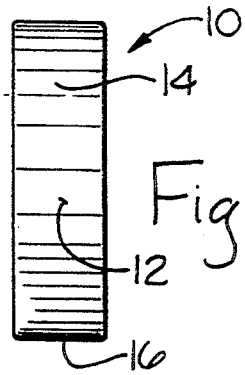
FIG. 5 is a front elevation of the device of the present invention.
Figure 6:
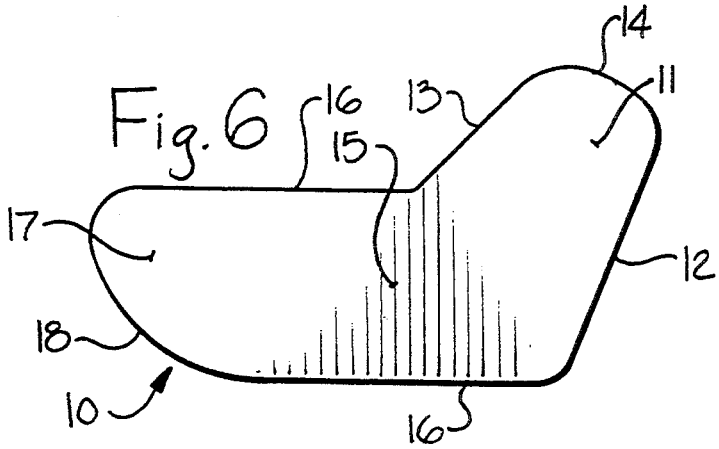
FIG. 6 is a side elevation view of the device of the present invention showing the leading edge of the front segment formed as a straight edge.

Referring now to FIGS. 1–8, the hand lever of the present invention is a rigid, non-compressible, lightweight elongated hand-held device 10. The hand lever may be totally enclosed in the hand of a person and is formed from segments which the fingers and the palm of the hand completely envelope.

The device 10 is kidney-shaped and is formed from three (3) segments. The front segment 11 has a leading edge 12 on one side and a trailing edge 13 on the opposite side of the kidney-shaped device 10. A curved top portion 14 of the front segment 11 connects the leading edge 12 with the trailing edge 13. An intermediate segment 15 adjoins the front segment 11. The top and bottom edges 16 of the intermediate segment 15 may be concave or straight. The junction between the trailing edge 13 of the front segment 11 and the top edge 16 of the intermediate segment 15 is concave. Adjoining the intermediate segment 15 is the rear segment 17. The rear segment 17 has a convex edge 18 distal from the leading edge 12 of the front segment 11. The use of the term "segment" herein is for ease of description, the device 10 is unitary and is not divided nor formed of discrete and separable parts. It is preferred that the surfaces of the device 10 be smooth and planar without depressions or burrs so as to be easily and comfortably held in the hand of the person. It is preferred that the device be approximately one-half (½) inch in thickness. The thickness may be greater or less but should be a thickness which is in conformity with the spacing between the joints of the user's fingers so that the device 10 is comfortably held by the user. Thus, a thicker device 10 would be used by a person with a large hand and a thinner device would be used by a person with a smaller hand. If the device 10 is too thin, it will not withstand the longitudinal pressure applied by the user and will break.

Figure 7:
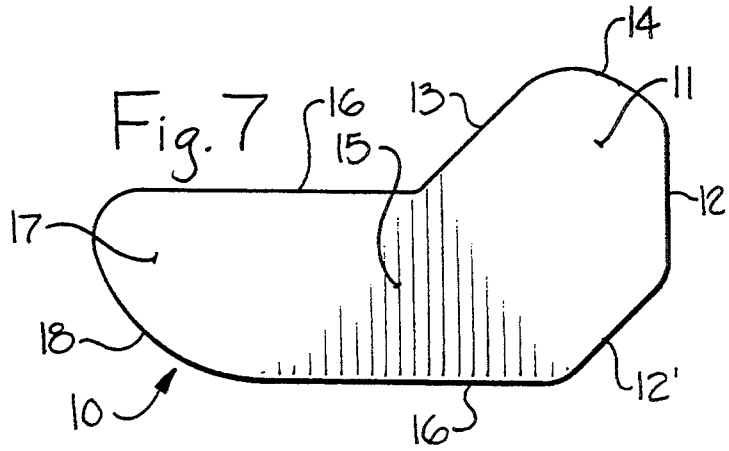
FIG. 7 is a side elevation view of the device of the present invention showing the leading edge of the front segment formed as two straight edges.
Figure 8:
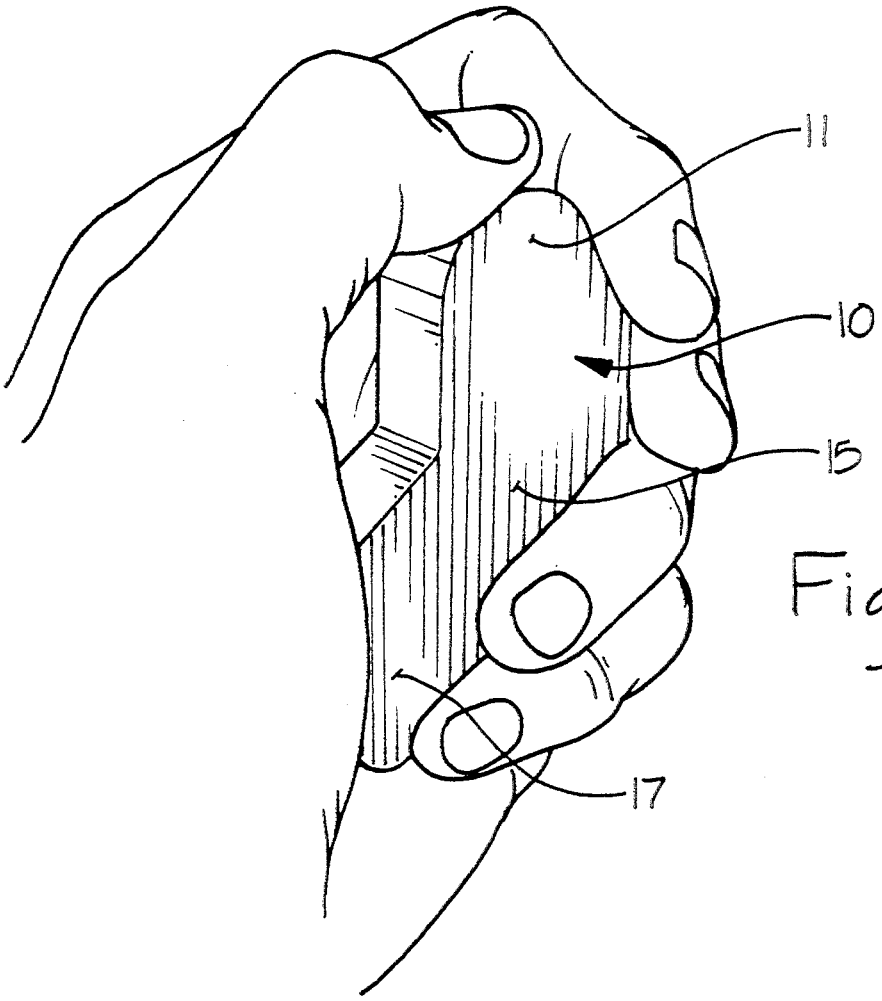
FIG. 8 is a perspective view showing the device of the present invention gripped in the hand of the user.

The leading edge 12 of the front segment 11 may be convex or straight (FIGS. 2, 3 and 6) or alternately may be formed of two portions. Both of these portions 12, 12' may be straight (FIG. 7).

Figure 9:
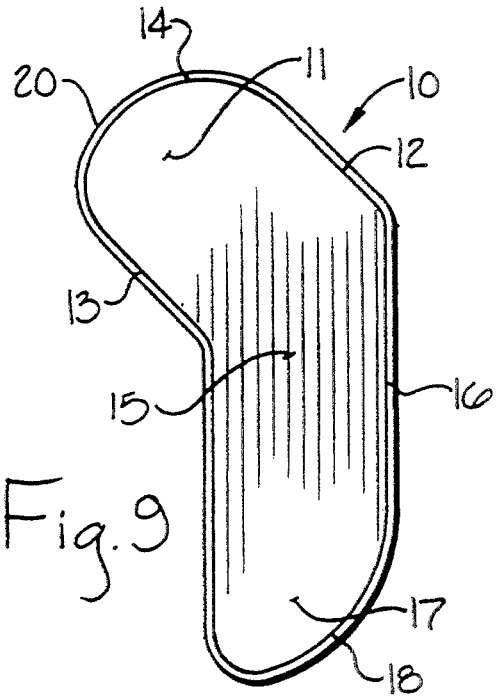
FIG. 9 is a side elevation view showing an outer edge disposed on the device of the present invention.

If desired, an elastomeric or rubber outer edge 20 may be disposed on at least a portion of the periphery of the device 10. The outer edge 20 may have ribs formed thereon. The outer edge 20 serves to assist the person in holding the device 10 in the person's hand with a minimal of slippage. (FIG. 9).

The device 10 is held in the person's hand with at least the index finger and, if desired, the adjoining finger or fingers articulated around the leading edge 12 of the front segment 11. The device 10 is pressed into the palm of the hand so that the convex edge 17 of the rear segment 17 contacts the palm or heel of the palm of the hand. In this manner, when the person holding the device 10 is running, jogging, walking or skating, the device directs and extends the force of the forearm drive. The elbow of the person acts as the fulcrum of the arm stroke and the energy of the upper body is transmitted through the rear segment 17, to the intermediate segment 15 and up and out through the front segment 11. The thumb of the person contacts the curved top 14 of the front segment 11. In capping the top 14, the hand stroke is stabilized and the body is balanced.

The hand lever aids in the forward locomotion of the person as follows:

The hand lever device 10 sets foot speed, that is the pace of rhythm of the binary arm and leg strokes, sets focus, that is the alignment of the body's kinetic power points, sets verticality, that is the angle of the body's spinal column to the horizontal surface plane, and sets turn, that is the lateral rotation of the body's hip and shoulder blades. Taken together, the hand lever 10 aligns, intensifies and projects the hand, forearms and ultimately, the total body drive through space.

The device 10 of the present invention may be formed of wood, plastic or lightweight material (such as graphite or aluminum). It must be rigid and not compressible.

What is claimed is:

1. A runner's aid for extended running whereby the force of a runner's upper body is driven through the runner's hand and up and out through the extremities of the runner's fingers thereby enhancing the propulsion of the runner through space, the runner's aid comprising: a rigid, non-compressible, lightweight, linear member having a front segment joined to an intermediate segment and a rear segment joined to the intermediate segment, the front segment having a leading edge, a trailing edge and a top convexly-shaped edge therebetween, the front segment further having a length along a first axis extending between the intermediate segment and the top edge of the front segment, the leading edge of the front segment being joined obtusely to the intermediate segment, the intermediate segment being linear and continuous with the rear segment, the rear segment having an uninterrupted convex edge thereon, the rear segment and the intermediate segments each having a respective length, the combined lengths being along a second axis, the first axis being disposed at an obtuse angle with respect to the second axis, the runner's aid being configured to fit in the palm of the runner's hand, the leading edge of the front segment being gripped by the fingers of the runner holding the runner's aid, the top edge being held by the thumb of the person holding the runner's aid, wherein when the runner's aid is gripped by the person, the rear segment is pressed into the hand toward the heel of the runner's hand, energy of the upper body being transmitted through the rear segment, through the intermediate segment and up and out through the front segment, the runner's thumb capping the front segment and acting to stabilize a hand stroke and balance the runner.

2. The hand lever of claim 1, wherein the leading edge of the front segment is convex.

3. The hand lever of claim 1, wherein the leading edge of the front segment is straight.

4. The hand lever of claim 1, wherein the leading edge of the front segment is formed of two straight portions joined at an obtuse angle.

5. The hand lever of claim 1, wherein the leading edge of the front segment has a length, the length being equal to the widths of the index finger and at least one additional finger of the person's hand.

6. The hand lever of claim 1, wherein the hand lever has a periphery, at least a portion of the periphery having an elastomeric covering disposed thereon.

7. The hand lever of claim 6, wherein the periphery about the front segment has the elastomeric cover disposed thereon.

8. The hand lever of claim 6, wherein the periphery about the rear segment has the elastomeric cover disposed thereon.

9. The hand lever of claim 6, wherein the periphery about the front segment and the rear segment have the elastomeric cover disposed thereon.

10. The hand lever of claim 6, wherein the periphery about the front segment and the intermediate segment have the elastomeric cover disposed thereon.

11. The hand lever of claim 6, wherein the periphery about the rear segment and the intermediate segment have the elastomeric cover disposed thereon.

12. The hand lever of claim 6, wherein the periphery about the front, intermediate and rear segments have the elastomeric cover disposed thereon.

* * * * *